US010862220B2

(12) United States Patent
Mak et al.

(10) Patent No.: US 10,862,220 B2
(45) Date of Patent: Dec. 8, 2020

(54) ANTENNA FOR USE IN ELECTRONIC COMMUNICATION SYSTEMS

(71) Applicant: STAR Systems International Limited, Hong Kong (CN)

(72) Inventors: Chi Lun Mak, Hong Kong (CN); Hau Wah Lai, Hong Kong (CN); Ka Ming Mak, Hong Kong (CN); Kwok Kan So, Hong Kong (CN); Hang Wong, Hong Kong (CN)

(73) Assignee: STAR SYSTEMS INTERNATIONAL LIMITED, Hong Kong (CN)

( * ) Notice: Subject to any disclaimer, the term of this patent is extended or adjusted under 35 U.S.C. 154(b) by 0 days.

(21) Appl. No.: 16/464,788

(22) PCT Filed: Aug. 30, 2017

(86) PCT No.: PCT/CN2017/099725
§ 371 (c)(1),
(2) Date: May 29, 2019

(87) PCT Pub. No.: WO2019/041180
PCT Pub. Date: Mar. 7, 2019

(65) Prior Publication Data

US 2019/0319366 A1 Oct. 17, 2019

(51) Int. Cl.

| | |
|---|---|
| ***H01Q 21/06*** | (2006.01) |
| ***H01Q 5/357*** | (2015.01) |
| ***H01P 5/12*** | (2006.01) |
| ***H01Q 9/04*** | (2006.01) |
| ***H01Q 13/08*** | (2006.01) |
| ***H01Q 21/00*** | (2006.01) |

(52) U.S. Cl.
CPC ..... *H01Q 21/065* (2013.01); *H01P 5/12* (2013.01); *H01Q 5/357* (2015.01); *H01Q 9/045* (2013.01); *H01Q 9/0485* (2013.01); *H01Q 13/08* (2013.01); *H01Q 21/0087* (2013.01)

(58) Field of Classification Search
CPC ..... H01Q 1/523; H01Q 5/35; H01Q 5/50; H01Q 9/045; H01Q 21/065; H01Q 21/24
USPC ..... 343/700 MS, 853, 884
See application file for complete search history.

(56) References Cited

U.S. PATENT DOCUMENTS 4,843,400 A * 6/1989 Tsao ..... H01Q 9/0428 343/700 MS
5,661,494 A * 8/1997 Bondyopadhyay .... H01Q 1/364 343/700 MS (Continued)

FOREIGN PATENT DOCUMENTS

CN 101388491 A 3/2009
CN 101807749 A 8/2010

(Continued)

*Primary Examiner* — Tung X Le
(74) *Attorney, Agent, or Firm* — Bayramoglu Law Offices LLC

(57) ABSTRACT

A system and method for an antenna including two or more radiation elements on a side of a substrate; a ground plane on an opposite side of the substrate; and a feeding network including a plurality of branch feeding elements. Each of the radiation elements has one or more feeding ports such that each of the plurality of branch feeding element is connected to a feeding port of a respective one of the radiation elements.

19 Claims, 20 Drawing Sheets

(56) References Cited

U.S. PATENT DOCUMENTS

| | | | | |
|---|---|---|---|---|
| 6,535,169 | B2 * | 3/2003 | Fourdeux | H01Q 21/065 343/700 MS |
| 7,839,350 | B2 * | 11/2010 | Nagai | H01Q 9/045 343/850 |
| 2001/0043157 | A1 | 11/2001 | Luk et al. | |
| 2007/0080888 | A1 * | 4/2007 | Mohamadi | H01Q 21/0025 343/853 |
| 2011/0090129 | A1 * | 4/2011 | Weily | H01Q 21/24 343/770 |
| 2016/0218438 | A1 * | 7/2016 | Miraftab | H01Q 21/0037 |
| 2016/0226155 | A1 * | 8/2016 | Warnick | H01Q 21/0075 |
| 2017/0365934 | A1 * | 12/2017 | Wilkins | H01Q 9/045 |
| 2018/0241135 | A1 * | 8/2018 | Furlan | H01Q 21/0006 |
| 2018/0366818 | A1 * | 12/2018 | Kawaguchi | H01Q 21/065 |

FOREIGN PATENT DOCUMENTS

| | | | |
|---|---|---|---|
| CN | 201994425 | U | 9/2011 |
| CN | 106169649 | A | 11/2016 |

* cited by examiner $\lambda$ means $\lambda_g$ , the guided wavelength

Measured Radiation Patterns at 902MHz (Embodiment in Fig.2)

H-plane (x-z plane)

E-plane (y-z plane)

Measured Radiation Patterns at 902MHz
(Embodiment in Fig.4)

H-plane (x-z plane)

E-plane (y-z plane)

ANTENNA FOR USE IN ELECTRONIC COMMUNICATION SYSTEMS

CROSS-REFERENCE TO RELATED APPLICATION

This application is the United States national phase of International Application No. PCT/CN2017/099725 filed Aug. 30, 2017, the disclosure of which is hereby incorporated by reference in its entirety.

TECHNICAL FIELD

The invention relates to an antenna, and in particular, a compact and light array antenna for use in RFID applications such as electronic toll collection system.

BACKGROUND

A wireless antenna may be included in communication systems for use in RFID applications such as an electronic toll collection (ETC) system. UHF RFID technology has matured rapidly in recent years. In one example, the European Telecommunication Standard Institute (ETSI) has specified the RFID frequency bands are 865-868 MHz, Federal Communications Commission (FCC): 902-928 MHz, and Global: 860-960 MHz.

National interoperable tolling standard in the US: Congress law (MAP21) to take effect in October 2016 requiring common tolling standard across the US country. The passive UHF RFID Technology, EPCglobal Class 1 Generation 2 (ISO 18000-6C) standard or protocol, is one of the promising candidates for the nationwide interoperability of electronic toll collection programs.

Toll operators will require directional (narrow beam) and high gain antenna, which is one of the crucial components (Antenna, Reader, Tags) of the passive RFID tolling solution.

To ensure reliability of the ETC system, more than 1 antenna may be used for each vehicle lane. Thus, for a read point with multiple lanes, lots of antennas are mounted on a gantry across the road. Therefore, low-profile, small-size and light-weight antennas are preferred.

Small-size and light-weight antennas are benefiting to minimize inventory costs and shipping costs.

SUMMARY OF THE INVENTION

It is, therefore, an object of the present invention is to provide a small-size and light-weight array antenna in which the multiple numbers of antenna elements may receive or transmit radio frequency waves at different phases, constructing waves and thus increasing gain in a narrow desired angle beamwidth, while signals from other directions will be destructed by destructive interference.

Other objects and advantages will become apparent when taken into consideration with the following specification and drawings.

It is also an object of the present invention to overcome or ameliorate at least one of the disadvantages of the prior art, or to provide a useful alternative.

It is a first aspect of the present invention to provide an antenna comprising: two or more radiation elements on a side of a substrate; a ground plane on an opposite side of the substrate; and a feeding network including a plurality of branch feeding elements; wherein each radiation elements has one or more feeding ports such that each of the plurality of branch feeding element is connected to a feeding port of a respective one of the radiation elements.

Preferably, a number of radiation elements is different from a number of the branch feeding elements.

Preferably, the antenna further comprises n number of radiation elements, and m number of branch feeding elements such that m>n>1.

Preferably, each radiation element comprises one or more low profile conductive strip or patch.

Preferably, each radiation element includes an arbitrary shape.

Preferably, the substrate is a dielectric substrate.

Preferably, the substrate includes an air-substrate.

Preferably, the two or more radiation elements are supported by a printed circuit board (PCB).

Preferably, each of the radiation elements is made of a conductive material.

Preferably, the conductive material is copper.

Preferably, each of the radiation elements is coated with a superstrate layer.

Preferably, each of the radiation elements is coated with a corrosion resistance material.

Preferably, the corrosion resistance material includes one or more of gold, tin, nickel, or metal alloy thereof.

Preferably, the ground plane is made of the said conductive material,

Preferably, the ground plane is made a light weight and strong metal.

Preferably, the PCB and/or the superstrate layer are made of relatively high dielectric-constant material. For example, the dielectric constant of the PCB is around 4.4, which may be a FR4 PCB.

Preferably, the dielectric constant of the substrate between the radiation elements and the ground is as low as possible.

Preferably, each radiation element has a substantially circular shape.

Preferably, each feeding port is located along a circumference or edge of the substantially circular shape.

Preferably, the branch feeding element comprises a microstrip line with numbers of sections of different length and width or tapering width.

Preferably, each of the branch feeding elements is connected to a feeding point of the feeding network.

Preferably, the feeding network connects to one or more optional matching stub.

Preferably, m is a power of 2 and n is an integer smaller than m and greater than 1.

Preferably, the radiation elements are arranged into three columns and two rows to form a 3×2 array structure.

Preferably, each radiation element of the first column has only one port connected to a branch feeding element.

Preferably, each radiation element of the second column has two ports at opposite ends of the radiation element, and each port is connected to a branch feeding element.

Preferably, each radiation element of the third column has only one port connecting to a branch feeding element.

Preferably, the feeding ports of the radiation element of the first column are adapted to operate at relatively 0 degree phase difference.

Preferably, the feeding ports of radiation elements in the second column adjacent to the first column are adapted to operate at relatively 180 degree phase difference.

Preferably, wherein the feeding ports of radiations elements in the second column adjacent to the third column are adapted to operate at relatively 0 degree phase difference.

Preferably, the feeding ports of the radiation elements in the third column are adapted to operate at relatively 180 degree phase difference.

Preferably, the radiation elements within a sub-region are adapted to operate in a same phase and linearly polarization along a direction parallel to the rows.

Preferably, the radiation elements are adapted to operate in a range of frequency between 865 MHz to 928 MHz.

Preferably, the branch feeding elements connected to the feeding ports operating in relatively 0 degree phase difference has a $d_2$ length, the branch feeding elements connected to the feeding ports operating in relatively 180 degree phase difference has a $d_1$ length, such that $d_1-d_2=(2n+1)(\lambda g/2)$, wherein $\lambda_g$ is the guided wavelength Preferably, two radiation elements in a same row have a space of around 190 mm between the centres of the radiation elements.

Preferably, two radiation elements in a same column have a space of around 220 mm between the centres of the radiation elements.

Preferably, n is an integer number greater than or equals to 2.

Preferably, the ground comprises a plurality of mounting and spacing elements arranged to support the PCB and/or the radiation elements.

Preferably, the substrate and/or the PCB comprises an aperture for receiving an antenna connector to connect with the feeding network on the PCB.

Preferably, the antenna further comprises a radome mounted at the top as a cover, with certain spacing apart from the PCB and/or the superstrate, which is on the substrate.

DESCRIPTION OF THE PREFERRED EMBODIMENT

Figure 1:
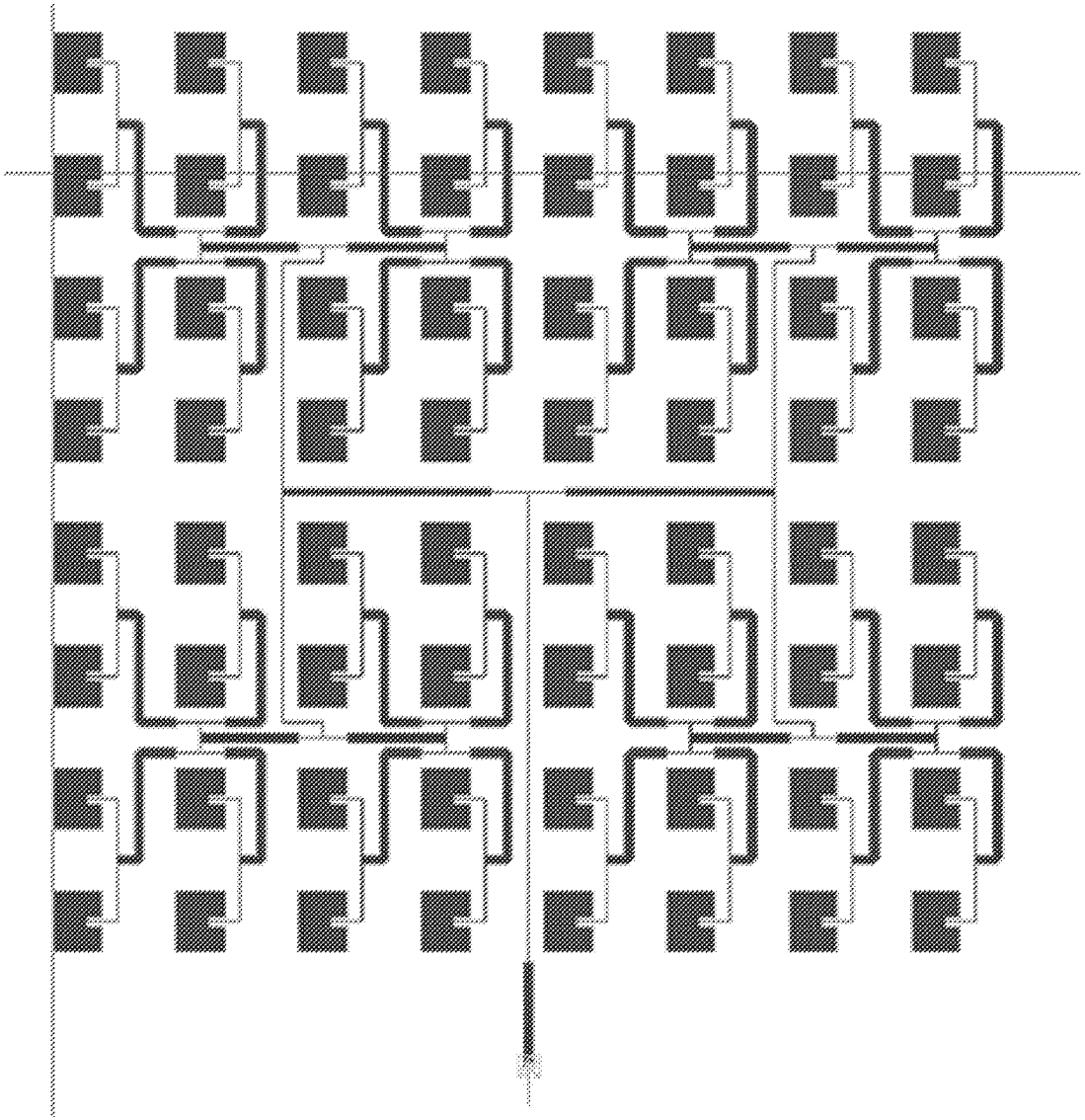
FIG. 1 is a schematic diagram of an example array antenna (m=n=64)

The inventors have, through their own research, trials and experiments, devised that array antenna may be designed to have n numbers of radiating elements (n ∈, 2, 3, 4, . . . ), where each has a single port which forms pairs with another, and are connected downstream via micro strips and eventually to the antenna feed where radio waves are converted to electric signals. Referring to FIG. 1, there is shown an example embodiment of an 8×8 array antenna with a 1 to 64 ports feeding network.

Since directivity and gain are proportional to antenna dimension, the required antenna may be large in size. For example, array antenna can increase directivity and gain, but size will become bigger.

Without wishing to be bound by theory, in electronic toll application, two or more antennae may be needed for each vehicle lane, numerous antennae are then required to be mount on one gantry, covering multiples lanes in one location.

In such applications, antenna need to compete for space with other apparatus (e.g. lighting apparatus, vehicle detection apparatus, ALPR (or ANPR) enforcement camera, etc.) in the very crowd environment on gantry. In this regard, small-sized array antenna and yet maintaining good enough radiation performance is desired. Inventory and logistics costs may also be minimized by using smaller and lighter array antenna.

In one example embodiment, microstrip patch antenna may be applied, which comprises a lower patch antenna layer having a dielectric layer and a ground plane, for radiating energy by exciting current by a feeding means electrically connected to a lower radiating patch on a side of the dielectric layer. The microstrip patch antenna further comprises a foam layer for distancing the upper patch antenna layer from the lower patch antenna layer by arranging the foam layer between the lower patch antenna layer and the upper patch antenna layer. There is also a dielectric film on the foam layer, and an upper patch antenna layer having a dielectric film, for radiating energy by exciting current by the lower radiating patch electromagnetically connected to an upper radiating patch on a side of the dielectric film. There is also a dielectric superstrate located a predetermined distance above the upper patch antenna layer. This design provides an antenna array with wide bandwidth and high antenna gain. However, the manufacture process of stack layers of microstrip patch antenna is complex and cost ineffective.

In another example embodiment, there is provided an antenna module which comprises a ground layer; a first radiator over the ground layer; a first dielectric layer between the ground layer and the first radiator; a feeding network under said ground layer, and a second dielectric layer between the ground layer and the feeding network. The feeding network has multiple outputs configured for multiple beams. This prior art also provides a stacked layers to improve the output, bandwidth, and gain of the antenna. However, stacked configurations are typically more expensive to manufacture In yet another example embodiment, a dual-patch antenna may be used, which includes a ground plane, a first patch plate parallel to and separated from the ground plane by a separation distance, and a second patch plate separated from the ground plane by the separation distance. The first and second patch plates are coplanar and separated by a radiating slot. An excitation probe isolatedly passes through the ground plane and connects to the first patch plate. A first wall connects an edge of the first patch plate to the ground plane. The first wall is located approximately ¼ wavelength of a mid-band operating frequency from the radiating slot. A second wall connects an edge of the second patch plate to the ground plane. The second wall is located approximately ¼ wavelength of the mid-band operating frequency from the radiating slot. The dual-patch antennae may be organized in an array. Although such design allows high power application, the antenna is only suitable for a limit bandwidth applications such as VHF.

In accordance with an embodiment of the present invention, an antenna may be formed by feeding multiple microstrip patch antennae (the radiating elements), some radiating elements are fed by 1 of the n-port and some are fed by 2 of the n-port of the 1-to-n port corporate feed network.

With reference to FIGS. 2-7, there is provided an antenna 100 of a preferable embodiment of the present invention. The antenna 100 comprises two or more radiation elements 102 on a side of a substrate; a ground plane on an opposite side of the substrate; and a feeding network including a plurality of branch feeding elements; wherein each of the radiation elements has one or more feeding ports such that each of the plurality of branch feeding element is connected to a feeding port of a respective one of the radiation elements.

In this embodiment, the antenna 100 comprises a Printed Circuit Board (PCB) 118/122 for supporting the two or more radiation elements 102 on one side of the PCB. The ground plane is placed on an opposite side of the PCB. In one embodiment, the PCB may include a dielectric substrate having a dielectric constant of around 4.4 or a PR4 PCB.

On the PCB 122, there is provided a plurality of branch feeding elements 104. Each radiation elements 102 has one or more ports 106 such that each feeding element is connected to a port of a radiation element.

In a preferred embodiment, each radiation element 102 is one or more low profile conductive strip. Preferably, the conductive strip is made of a conductive material, and in particular, copper. The metal strip is preferably coated with a corrosion resistance material, such as gold, tin, nickel, or metal alloy thereof. In addition, the ground cavity or grand plane 140 may be made of aluminium which is a conductive material with light weight and strong physical properties.

Preferably, the substrate 120 may be made of a low dielectric-constant material. For example, air substrate is may be used. Air, including a dielectric constant of 1 is included as the substrate between the radiating elements 102 and the ground plane 140 in the antenna structure. Alternatively, foam or a porous material may be used to achieve a similar performance of the antenna in some example embodiments whilst providing an improved mechanical strength of the antenna structure. In addition, supporting ports or structures may be included to mechanically mount the different components when an air substrate is used.

Figure 7:
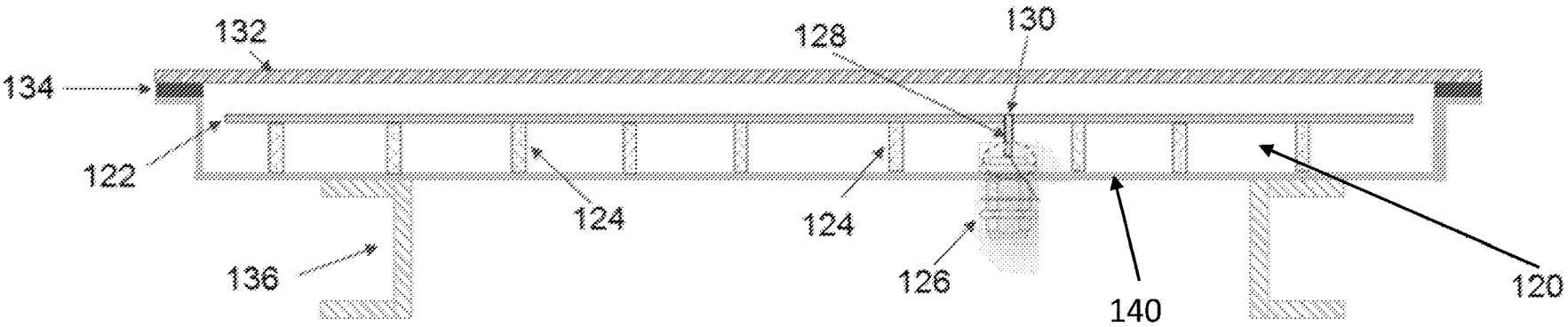
FIG. 7 is a cross-section view of the antenna of FIG. 6.

Referring to FIG. 7, the substrate 120, placed between the ground cavity 140 and PCB 122, has a perforation for a connector 126 (with feeding pin) connecting the antenna at a feed location 130 or 114. Mounting structure 136 is securely welded to the ground cavity 140. A radome 132 may be disposed on top, covering the whole structure including antenna PCB 122 (or 118). In one embodiment, the ground cavity 140 is equipped with mounting structure 136 for mounting the antenna on a gantry or other location or surface of the applicant. Inside or adjacent to the substrate 120, there is provided a plurality of supporting posts 124 locations for the metallic supporting posts for PCB 122 (or 118), and a number of the them (e.g. 6) provide DC short (short circuiting the 6 radiating elements 102, to ground at the center 110 of each radiating element 102). In some alternative example, the substrate 120 and or the PCB 118/122 may be provided with apertures for receiving the antenna connector 126 to connect with the patch 130 (or 114).

In the preferred embodiment shown in FIGS. 2 to 9 each radiation element has a substantially circular shape. The feeding ports 106 are located along a circumference or edge of the substantially circular shape.

In another embodiment, the radiation element may be arbitrary shaped, so that it may has a shape of a regular polygon such as a triangle, square, pentagon, hexagon, octagon, etc. The shape of the radiation element can also be a section of a circle, circle with a slot, a ring, a rectangle, an eclipse, etc.

The antenna design of the present invention may conventional 1 to n port coupled with a corporate feed network but fewer numbers (<n) of radiating elements. Number of radiating elements in the prior art is usually n.

The present invention is different in that the number of radiation elements may be different from the number of the branch feeding elements. Preferably, the antenna elements number may be smaller than that of branch feeding port numbers. E.g. 5-7 antenna elements can be coupled to a 1 to 8 port corporate feed network 3 elements can be coupled to a 1 to 4 port corporate feed network, while utilising all the available branch feeding ports. In other words, some of the radiating elements are fed by two or more branch feeding ports.

In an embodiment, the antenna 100 has n number of radiation elements 102, and m number of branch feeding elements 104 such that m>n>1.

Figure 2:
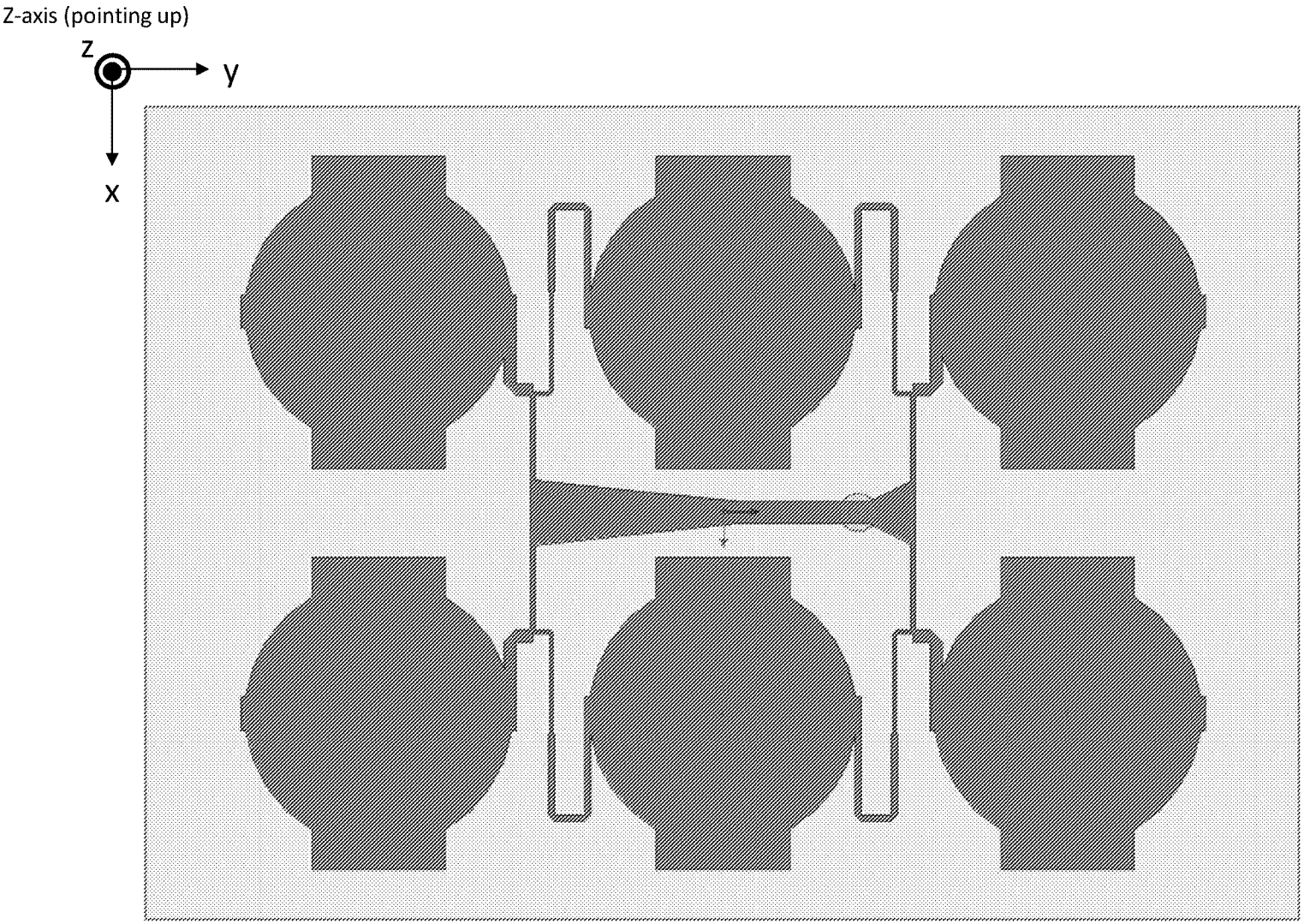
FIG. 2 is a schematic diagram of an antenna without an optional matching stub in accordance with an embodiment of the present invention.
Figure 3:
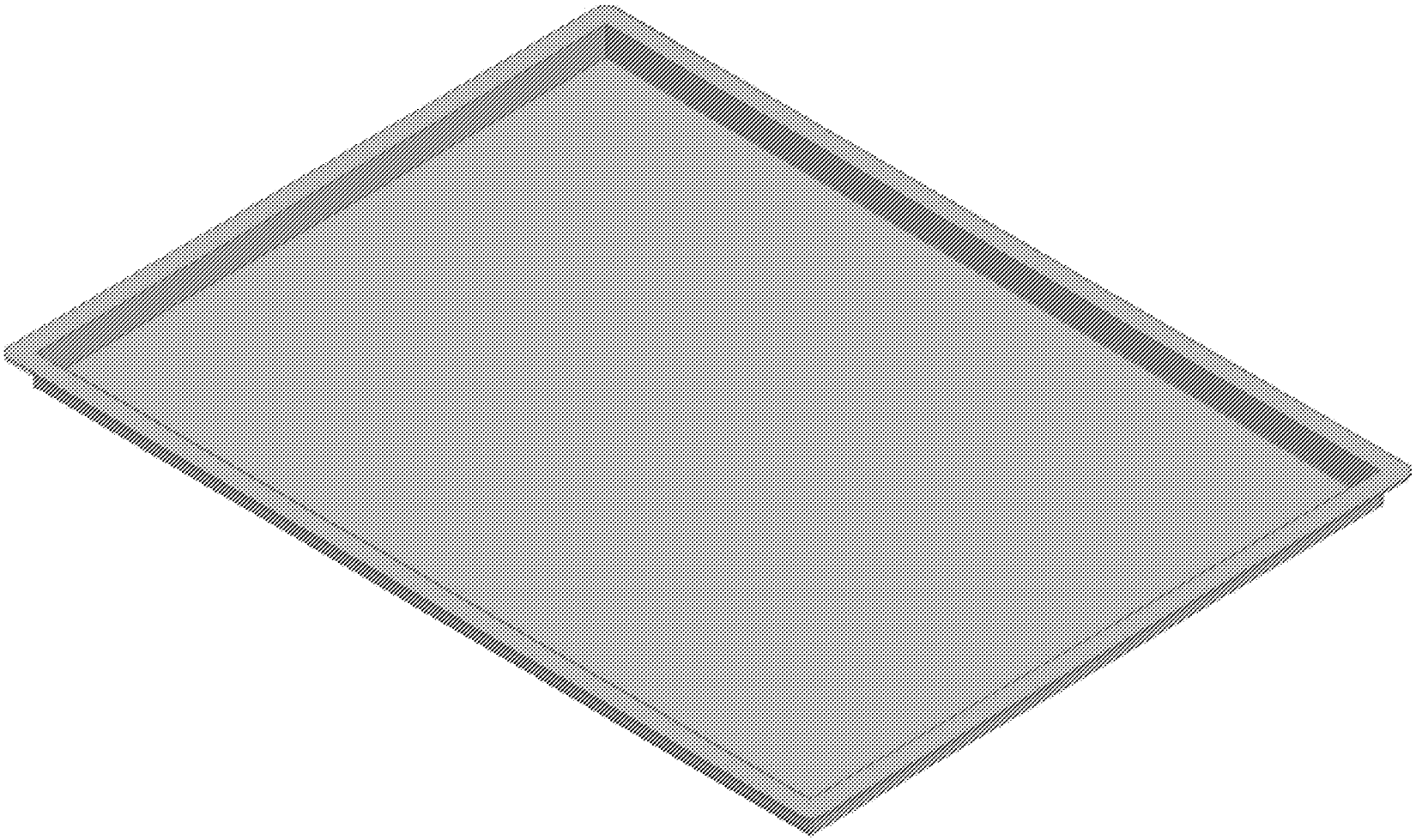
FIG. 3 is a schematic diagram of the ground plane with 4 vertical side walls of an antenna in accordance with an embodiment of the present invention.

In a preferred embodiment as shown in FIG. 2, the antenna has a 2×3 array antenna (i.e. 6 radiating elements, n=6) with a 1 to 8 port feeding network, m=8.

Figure 8:
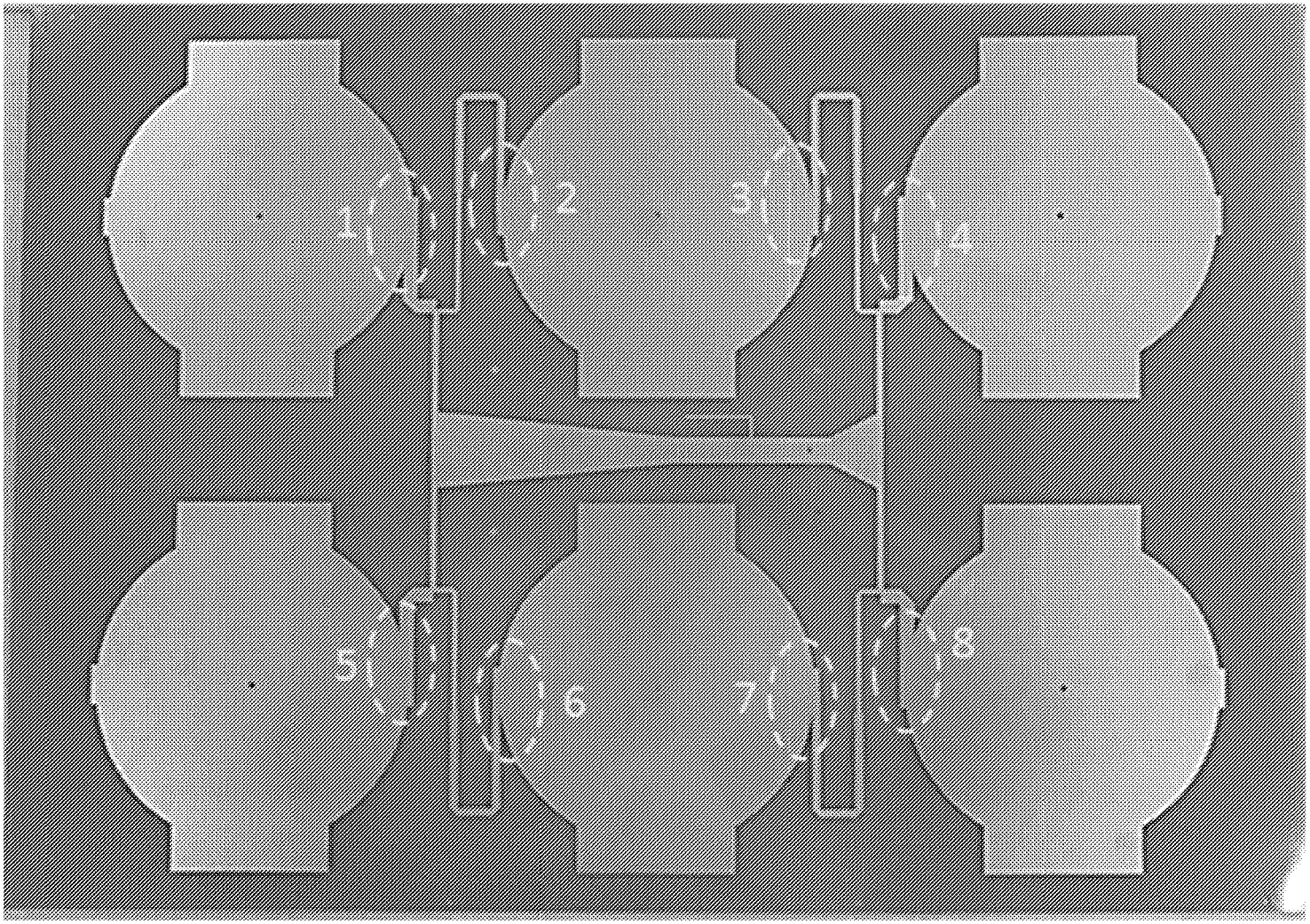
FIG. 8 is a schematic view of the PCB of the antenna of FIG. 4.
Figure 9:
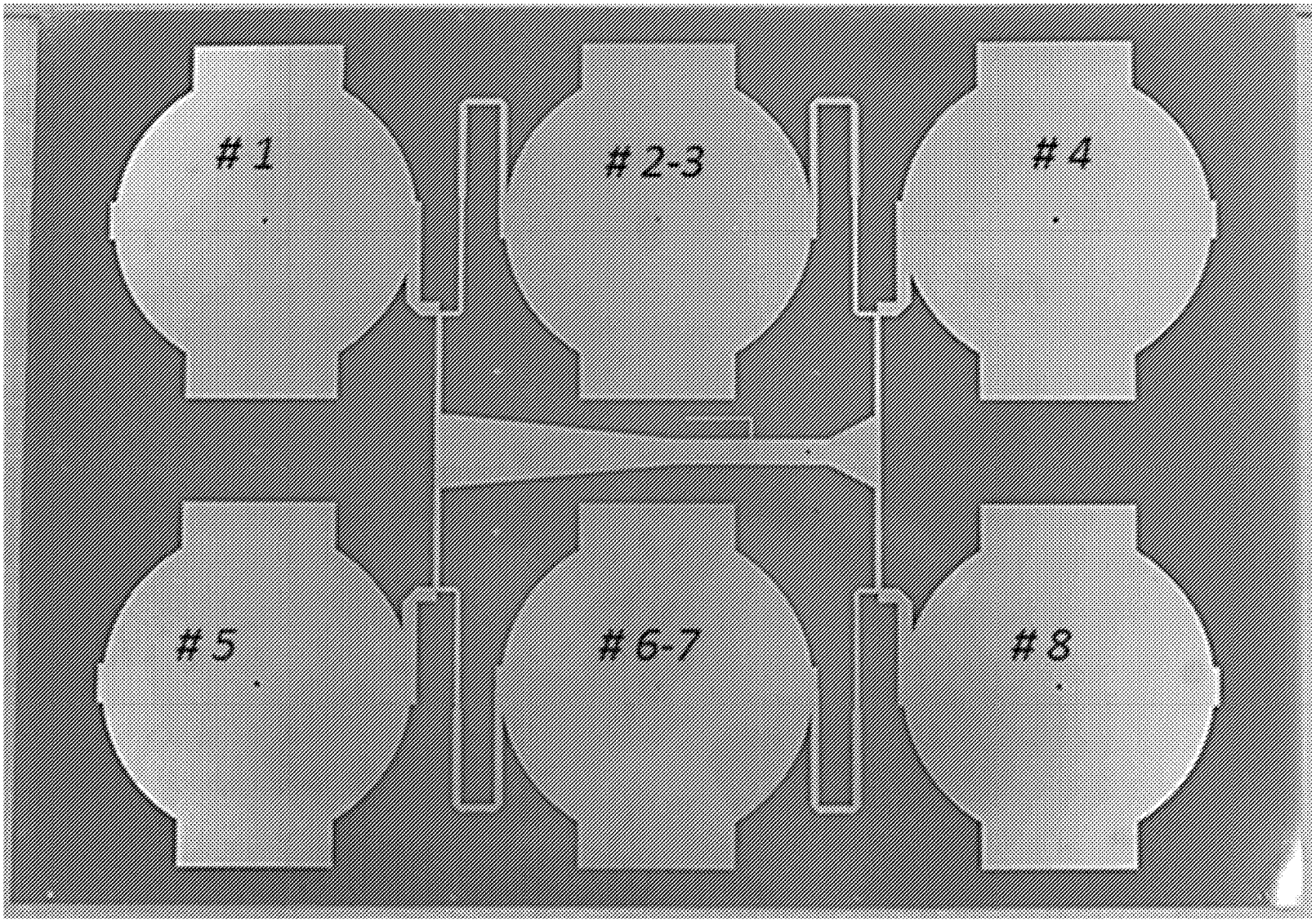
FIG. 9 is another schematic view of the PCB of the antenna of FIG. 4.

Preferably, some of the radiating elements are connected to two feeding ports each. As shown in FIG. 8, two of the radiating elements are connected to two feeding ports (one of the element are simultaneously fed at port 2 and port 3, another one of the element are simultaneously fed at port 6 and port 7). In this example, this causes the situation that ports (1,3,5,7) will have the opposite phases to ports (2,4, 6,8). Therefore the branch feeding element from 1 & 2 meet and branch out from a half-guided wavelength difference in distance to ensure 180 degree out of phase between port 1 and port 2. Port 1 & port 5 operate in the same phase thus branch out from the centre. Elements with two branch feeding ports receive similar power as other radiating elements. To ensure the maximum achievable gain, all radiating elements are controlled to have similar power.

To ensure maximum achievable gain, the feed network is target to distribute the same power from the connector 126 to all radiating elements, i.e. the target power ratio among all the 6 elements is 1:1:1:1:1:1.

To ensure maximum achievable gain, the feed network is target to feed all the 6 elements in the same phase, or opposite phase if the element is fed at opposite position.

To ensure maximum achievable gain, the feed network is target to provide an input impedance that conjugate match with the impedance of the connector 126.

Figure 5:
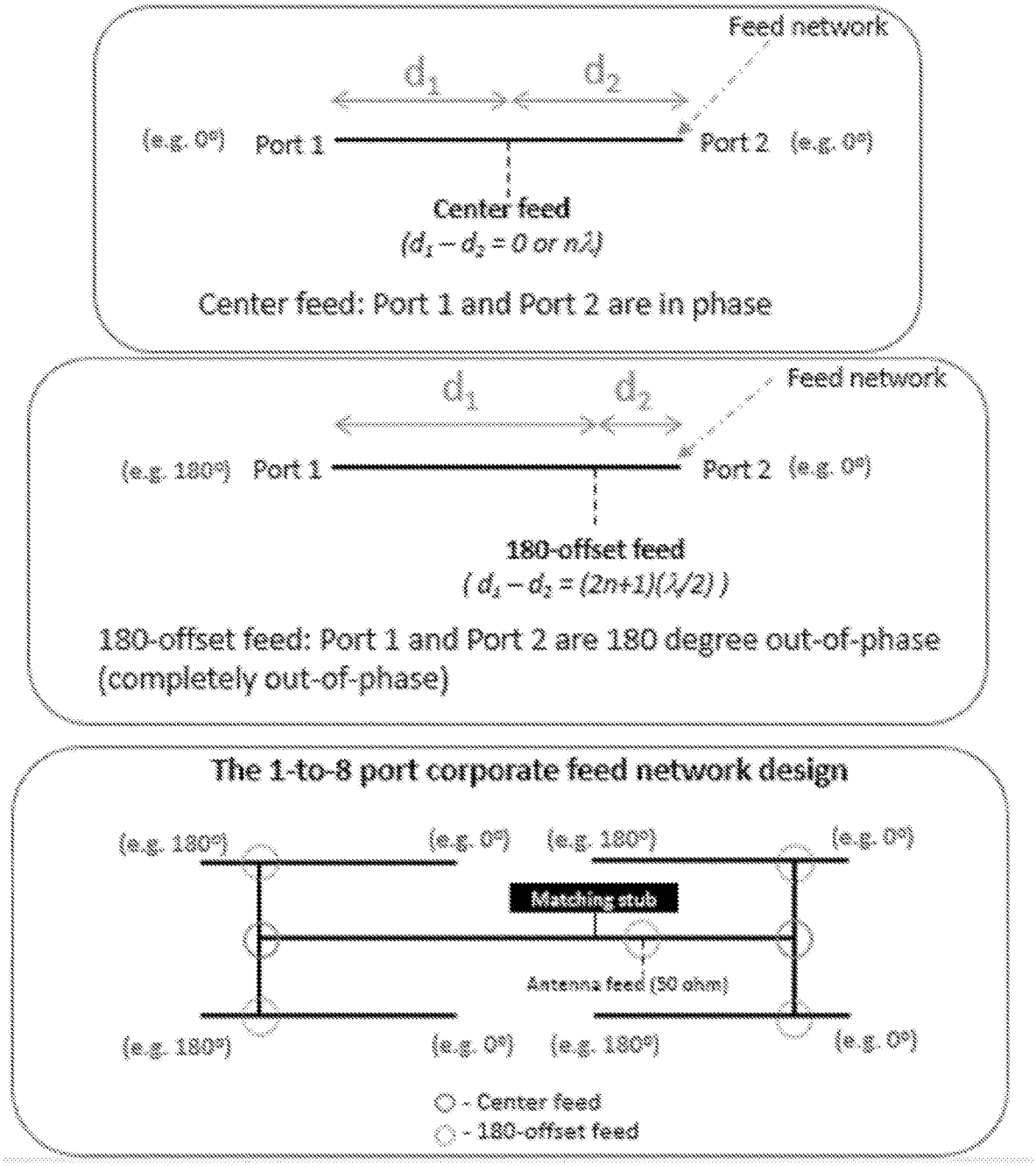
FIG. 5 is a process diagram to determine the length of a feeding element of the antenna of FIG. 2 and FIG. 4.
Figure 6:
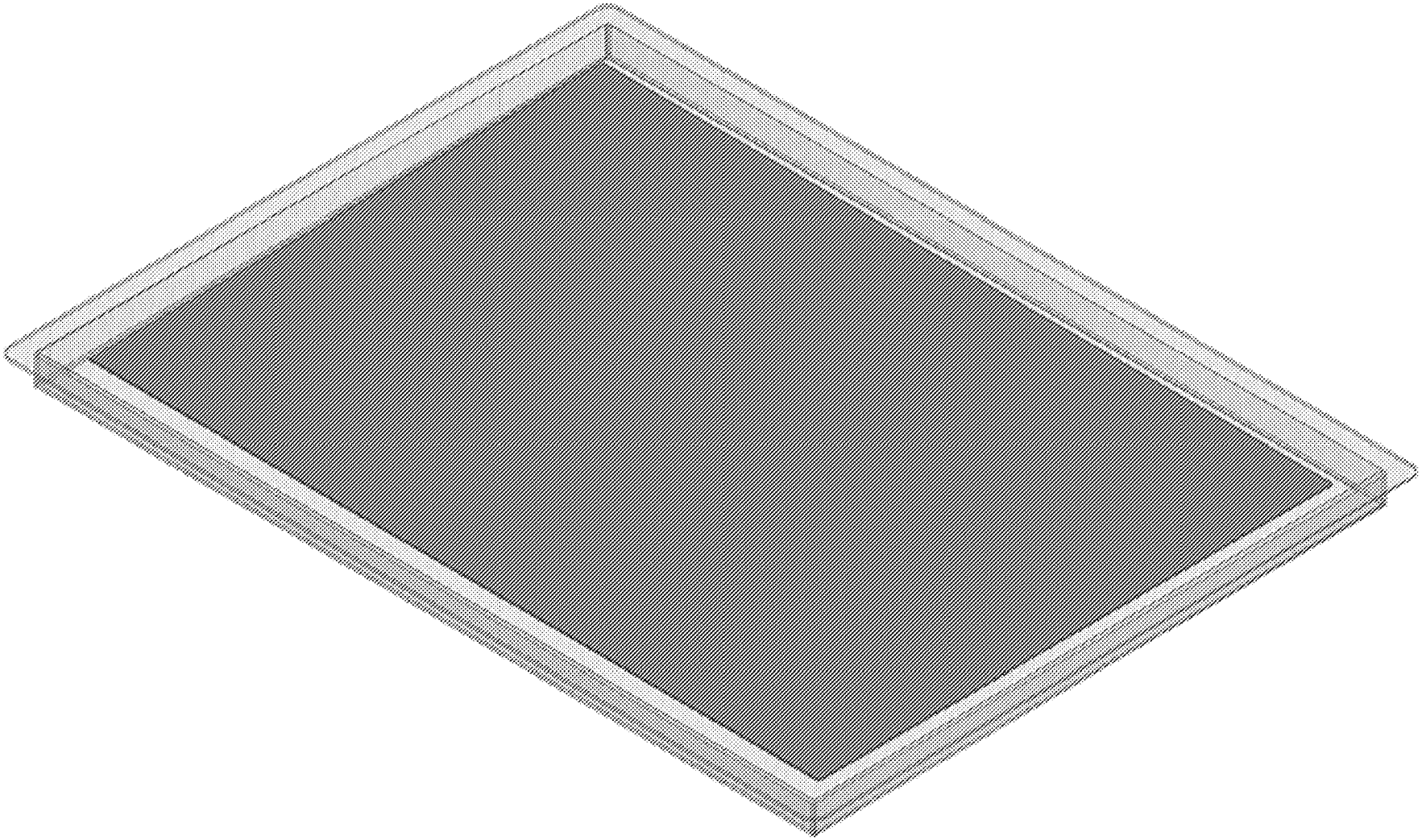
FIG. 6 is a schematic diagram of an antenna structure having the PCB, with antenna elements of FIGS. 2 and 4 being placed on a substrate inside the ground plane of in accordance with an embodiment of the present invention.

Referring to FIG. 5 which provides procedures to determine the distances of the branch feeding element. Assuming the branch feeding elements connected to the feeding ports (port 1, 3, 5, 7) operating in relative 0 degree phase difference has a $d_1$ length, and the branch feeding elements connected to the feeding ports (port 2, 4, 6, 8) operating in relative 180 degree phase difference has a $d_2$ length, then $d_2-d_1=(2n+1)(\lambda g/2)$.

In a preferred embodiment, the branch feeding element 104 comprises a micro strip line. The branch feeding elements 104 are then joined into a main feeding element 112, and further connected to the feeding point 114 of the feeding network. Preferably, at the feeding point 114, the feeding network connects to one or more optional matching stub 116, which help to fine tune the input impedance if necessary.

In a preferred embodiment shown in FIG. 2-9, there are m number of branch feeding elements 104 where m is power of 2 and n is a number of radiating elements where n is any integer smaller than m and greater than 1.

In an embodiment, where m and n are very large, it is preferable, that the patch is divided into multiple sub-region, wherein each sub-region has 6 radiation elements 102, and 8 branch feeding elements 104.

In a preferred embodiment as shown in FIG. 8, the radiation elements 102 are arranged into three columns and two rows. Each radiation element 102 of the first column has only one port 106 (port 1, port 5) connected to a branch feeding element 104. Each radiation element 102 of the second column has two ports 106 (port 2 and port 3, port 6 and port 7) at opposite ends of the radiation element, and each port 106 is connected to a branch feeding element 104. Each radiation element 102 of the third column has only one port 106 (port 4, port 8) connecting to a branch feeding element.

The feeding ports 104 (port 1, port 5) of the radiation element of the first column are adapted to operate at relative 0 degree phase difference.

The feeding ports 104 (port 2, port 6) of radiation elements in the second column adjacent to the first column are adapted to operate at relative 180 degree phase difference.

The feeding ports 104 (port 3, port 7) of radiations elements in the second column adjacent to the third column are adapted to operate at relative 0 degree phase difference.

The feeding ports 104 (port 4, port 8) of the radiation elements in the third column are adapted to operate at relative 180 degree phase difference.

To achieve the highest gain and have the main-beam in boresight direction, the 6 radiating elements are radiating in the same phase. The radiation elements 102 within a sub-region are adapted to operate in a same phase and linearly-polarized along a direction parallel to the rows (Y-direction).

Figure 4:
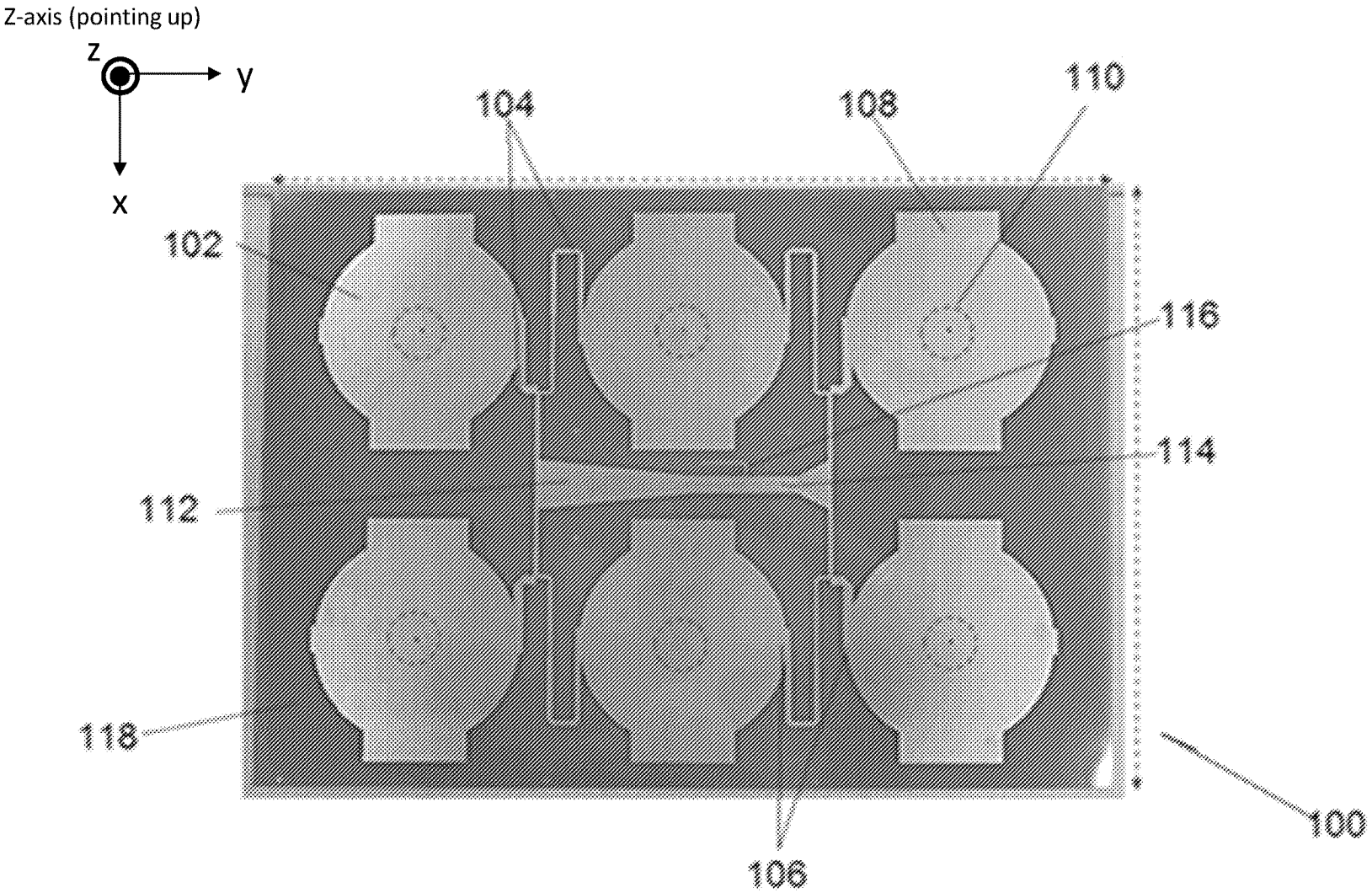
FIG. 4 is a schematic diagram of a PCB, with geometry of present invention of the antenna array, feeding element and an optional matching stub added thereon, of an antenna in accordance with an embodiment of the present invention.

Referring to FIG. 4, the radiating elements 104 are 190 mm 220 mm (0.55-0.68 operating wavelength, the operating frequency band is 865 MHz to 928 MHz) apart, the corporate feed network is designed to provide 50-ohm at antenna input port at connector 126. A matching stub 116 is used for fine tuning the matching. The 8 ports are designed to provide 2 sets of completely out-of-phase ports (ports (1, 3, 5, 7) and ports (2, 4, 6, 8) are 180 degree out of phase).

The radiation elements are adapted to operate in a range of frequency between 865 MHz to 928 MHz. In one embodiment, two radiation elements in a same row have a space of around 190 mm between the centres of the radiation elements. Two radiation elements in a same column have a space of around 220 mm between the centres of the radiation elements.

In one embodiment of the present invention, there is provide an 1 port to 8 ports (1-to-8 port) corporate feed network for only feeding (or exciting) 6 radiating elements. (i.e. not exciting 8 radiating elements as commonly done by others)

In another embodiment, the 1-to-m port corporate feed network for feeding (or exciting) n (m>n>1) radiating elements in array antenna design.

Figure 10:
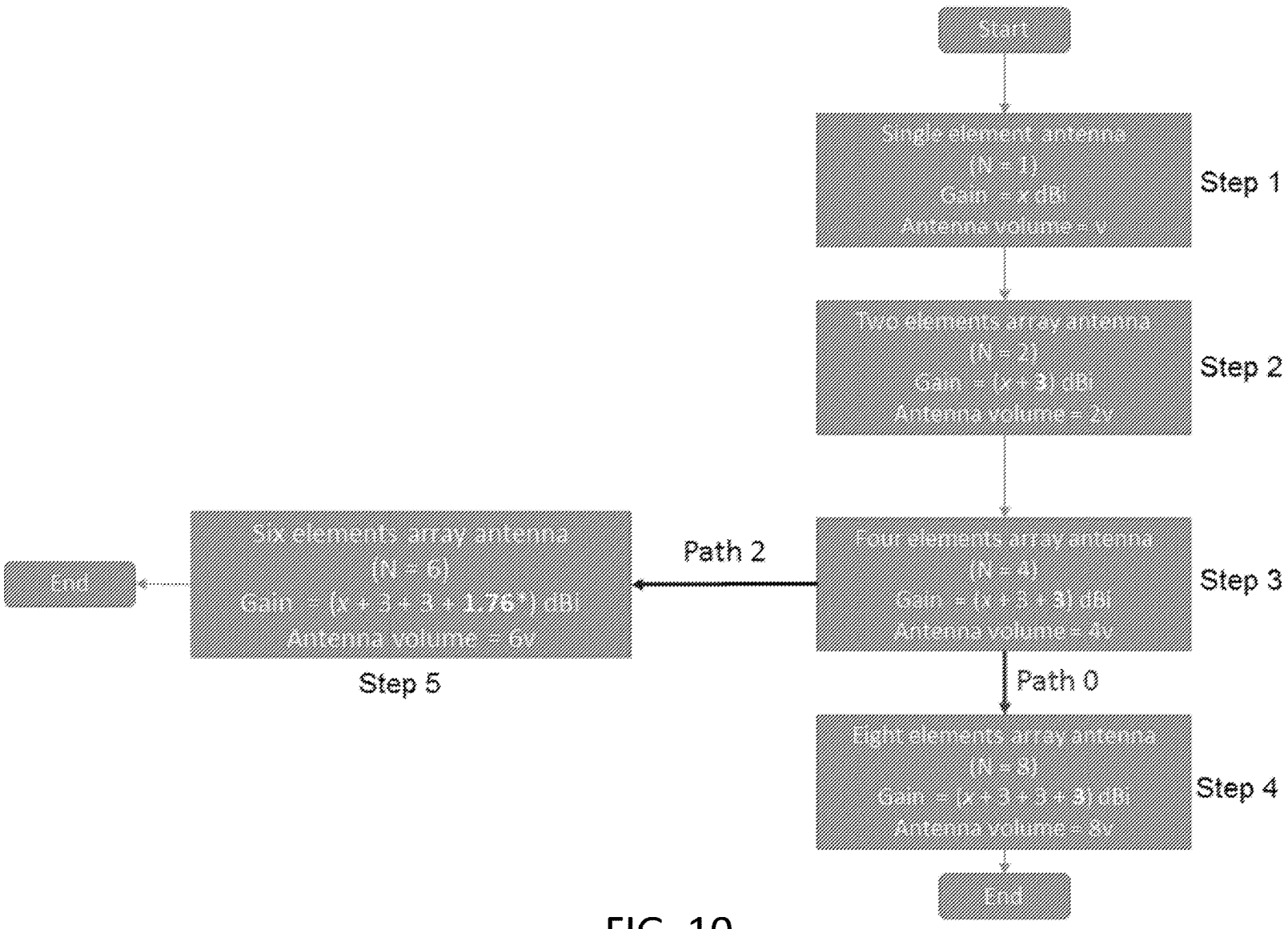
FIG. 10 is a flow chart for designing an antenna in accordance with an embodiment of the present invention.

Reference is now made to FIG. 10, which provide a flow chart for designing an antenna. Theoretically, gain will increased by 3 dB if number of radiating elements are doubled. However, overall size will be doubled too.

For the embodiment of the current invention of the 6 element array antenna, it may maintain the ease of 1-to-8 port corporate feed network design, and achieving 1.76 dB increment in gain but only 50% larger than the 4-element array antenna. (Choosing the non-obvious path 2 instead of the traditional path 0)

Step 1: Assume the gain of a single element antenna is x dBi, and occupying a volume of v $cm^3$.

Step 2: Using 1-to-2 port corporate feed network. Gain increased by 3 dB (compared to last step). Antenna volume increased by 100% (compared to last step).

Step 3: Using 1-to-4 port corporate feed network. Gain increased by 3 dB (compared to last step). Antenna volume increased by 100% (compared to last step).

Here, one example approach is taken for Step 4 where Step 4: Using 1-to-8 port corporate feed network. Gain increased by 3 dB (compared to last step). Antenna volume increased by 100% (compared to last step).

A preferred embodiment of the present invention would take Step 5, wherein Step 5: Using 1-to-8 port corporate feed network. Gain increased by 1.76 dB (compared to last step). Antenna volume increased by 50% (compared to last step). Theoretically, 10 log 10 (6/4)=1.76 dB.

Figure 11:
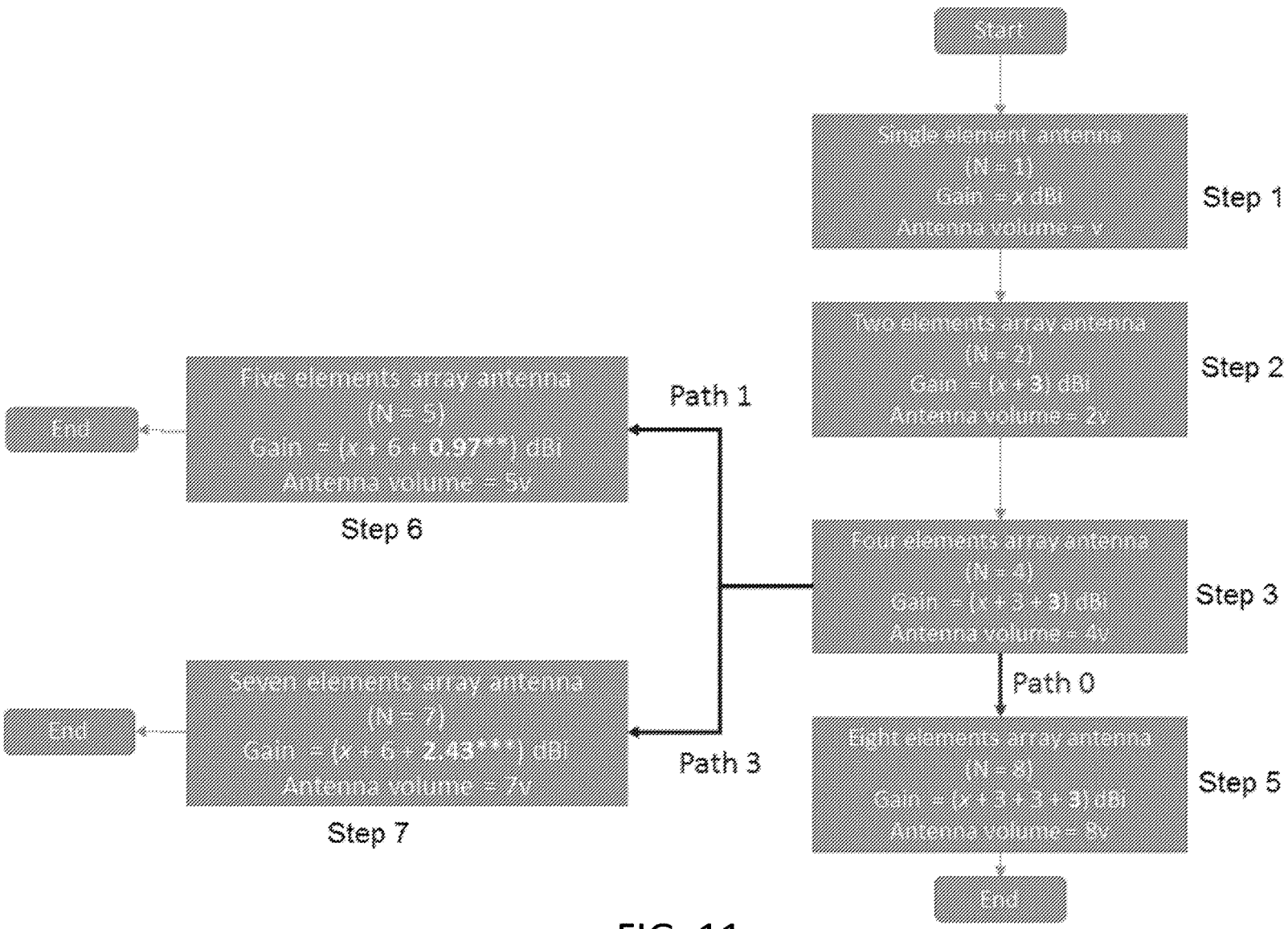
FIG. 11 is another flow chart for design an antenna of another embodiment of the present invention.

Referring to FIG. 11, another method of designing an antenna of the present invention is disclosed. Preferably, apart from N=6, it is possible to choose N=5 or N=7 and keep using the 1-to-8 port for the same benefits or argument of current invention. (i.e. choosing Path 1 or Path 3).

Step 1: Assume the gain of a single element antenna is x dBi, and occupying a volume of v $cm^3$.

Step 2: Using 1-to-2 port corporate feed network. Gain increased by 3 dB (compared to last step). Antenna volume increased by 100% (compared to last step).

Step 3: Using 1-to-4 port corporate feed network. Gain increased by 3 dB (compared to last step). Antenna volume increased by 100% (compared to last step).

Step 4 is taken as described in FIG. 10, wherein Step 4: Using 1-to-8 port corporate feed network. Gain increased by 3 dB (compared to last step). Antenna volume increased by 100% (compared to last step).

In an embodiment of the present invention, Step 5 or Step 6 may be taken.

Step 5: Using 1-to-8 port corporate feed network. Gain increased by 0.97 dB (compared to last step). Antenna volume increased by 25% (compared to last step). Theoretically, 10 log 10 (5/4)=0.97 dB.

Step 6: Using 1-to-8 port corporate feed network. Gain increased by 2.43 dB (compared to last step). Antenna volume increased by 75% (compared to last step). Theoretically, 10 log 10 (7/4)=2.43 dB.

Figure 12:
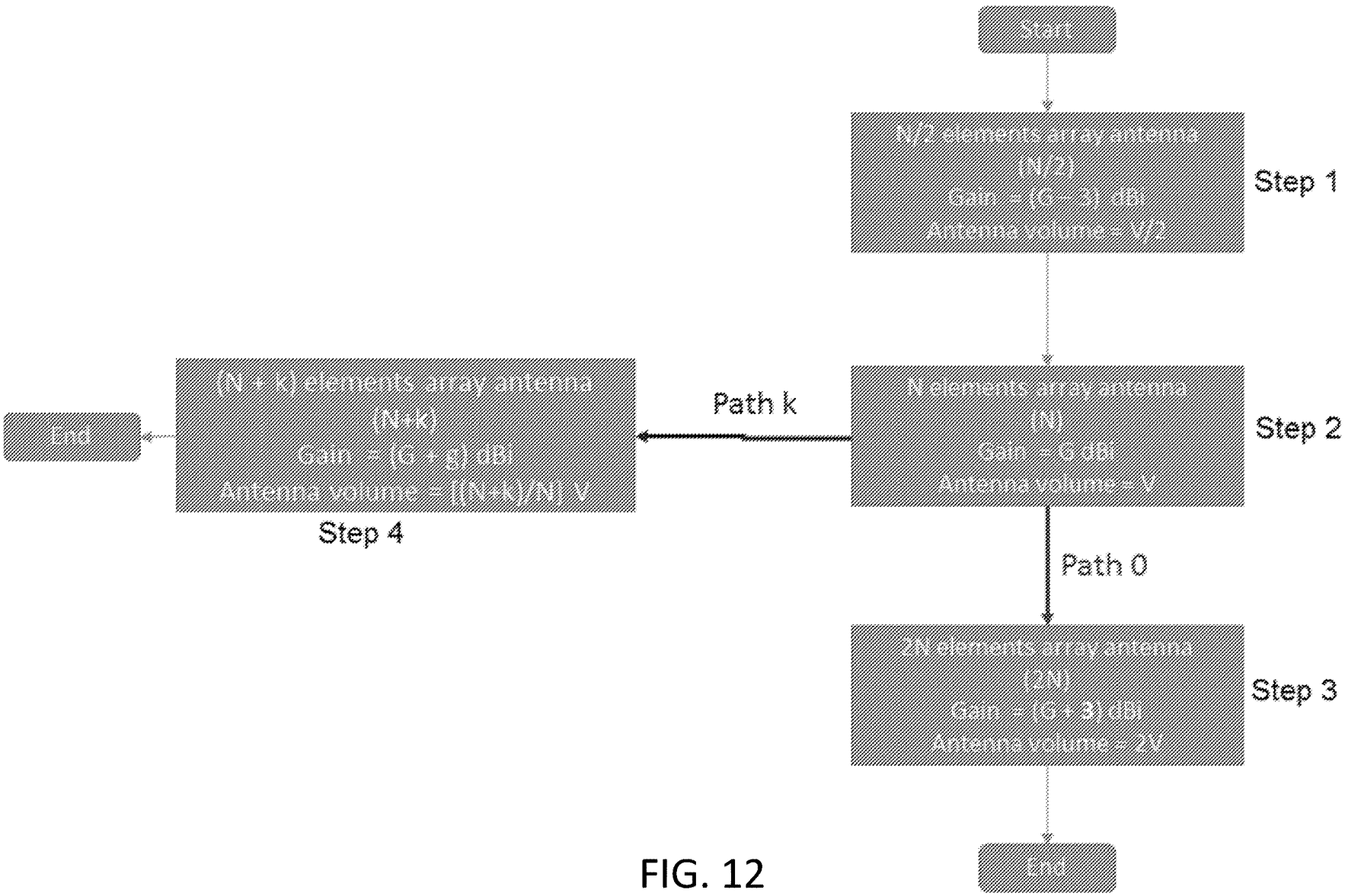
FIG. 12 is yet another flow chart in general for designing an antenna of an embodiment of the present invention.
Figure 13:
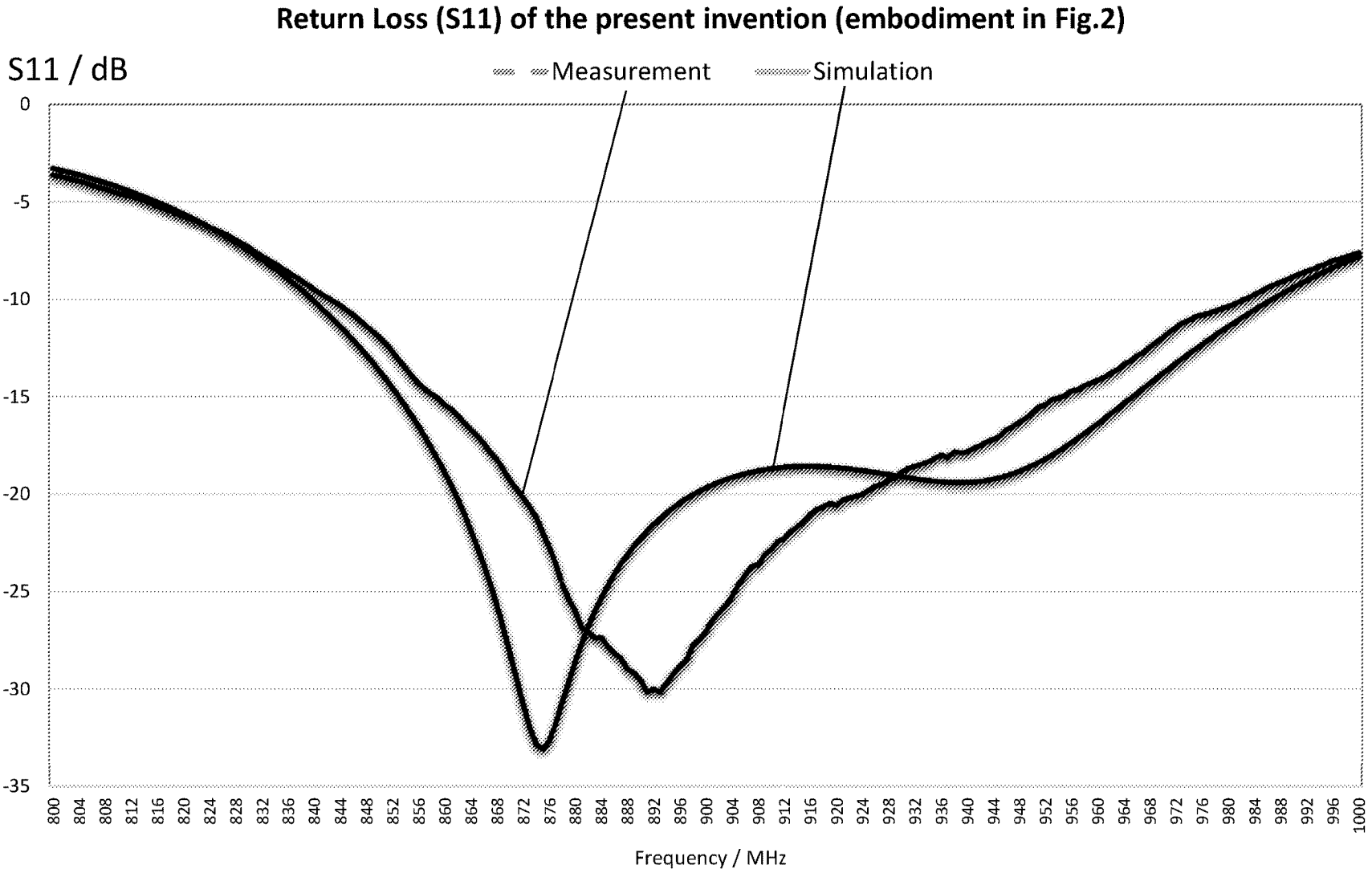
FIG. 13 is a plot showing the measured and simulated results of return loss of the antenna of FIG. 2.
Figure 14:
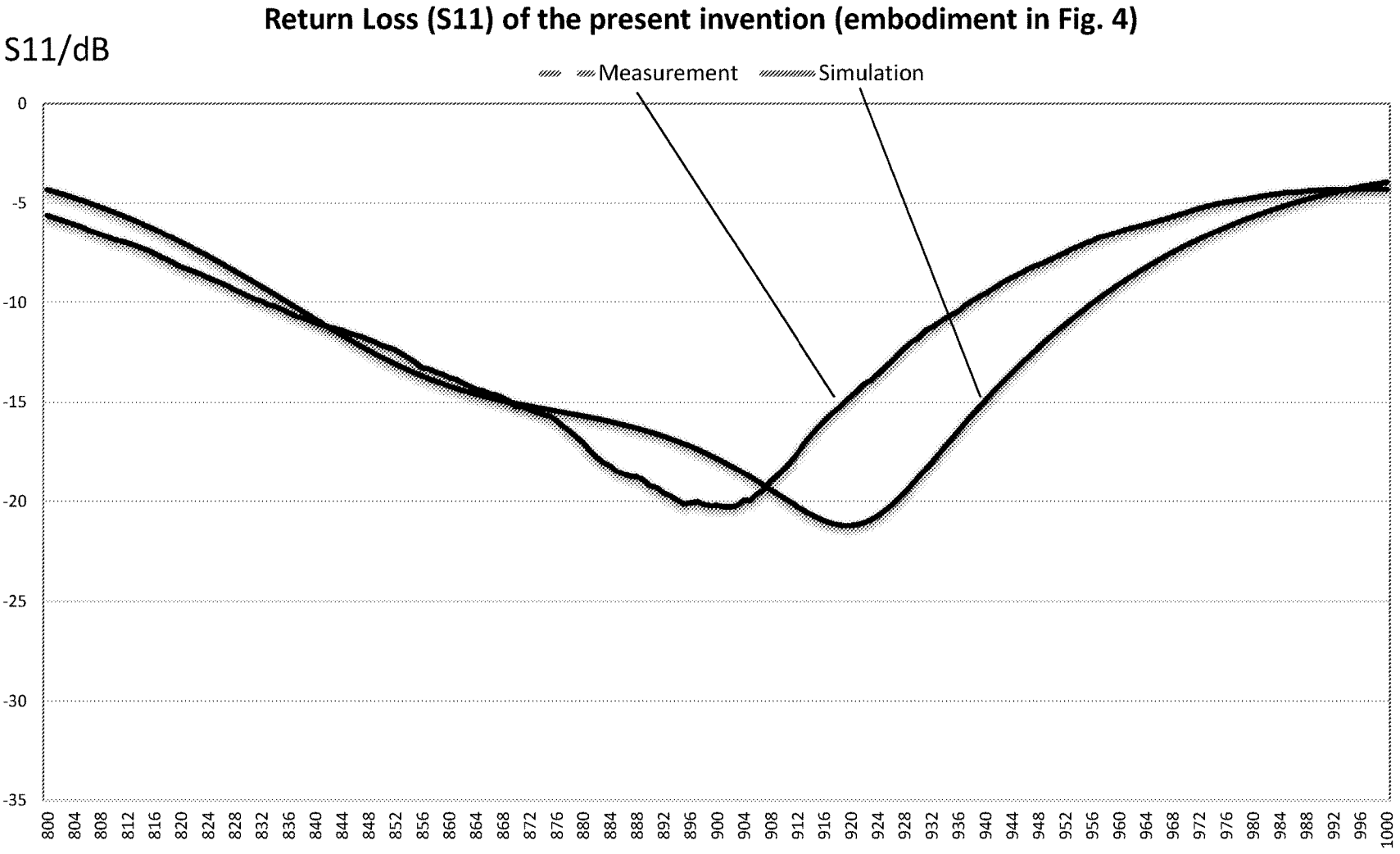
FIG. 14 is a plot showing the measured and simulated results of return loss of the antenna of FIG. 4.
Figure 15:
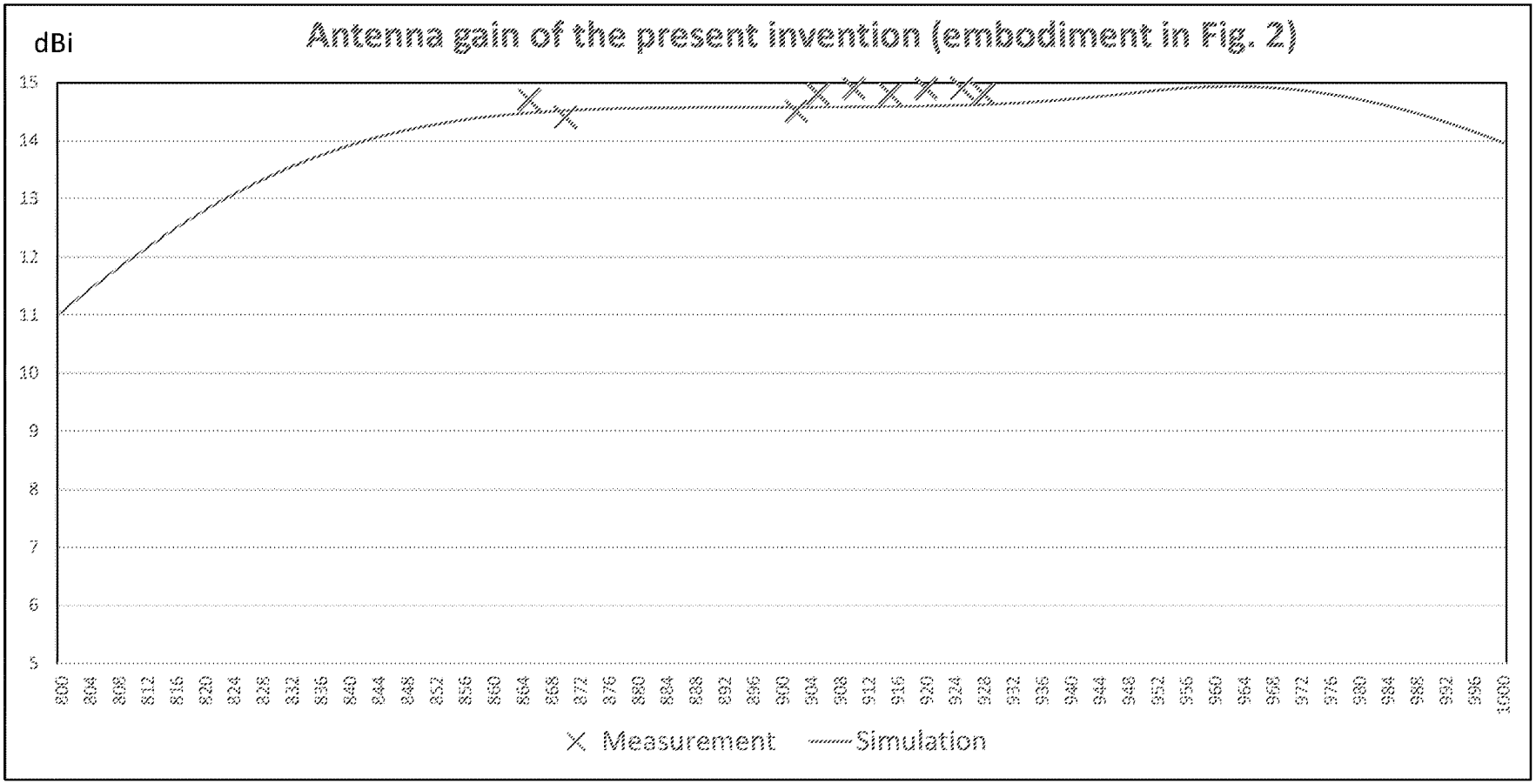
FIG. 15 is a plot showing the measured and simulated results of antenna gain of the antenna of FIG. 2.
Figure 16:
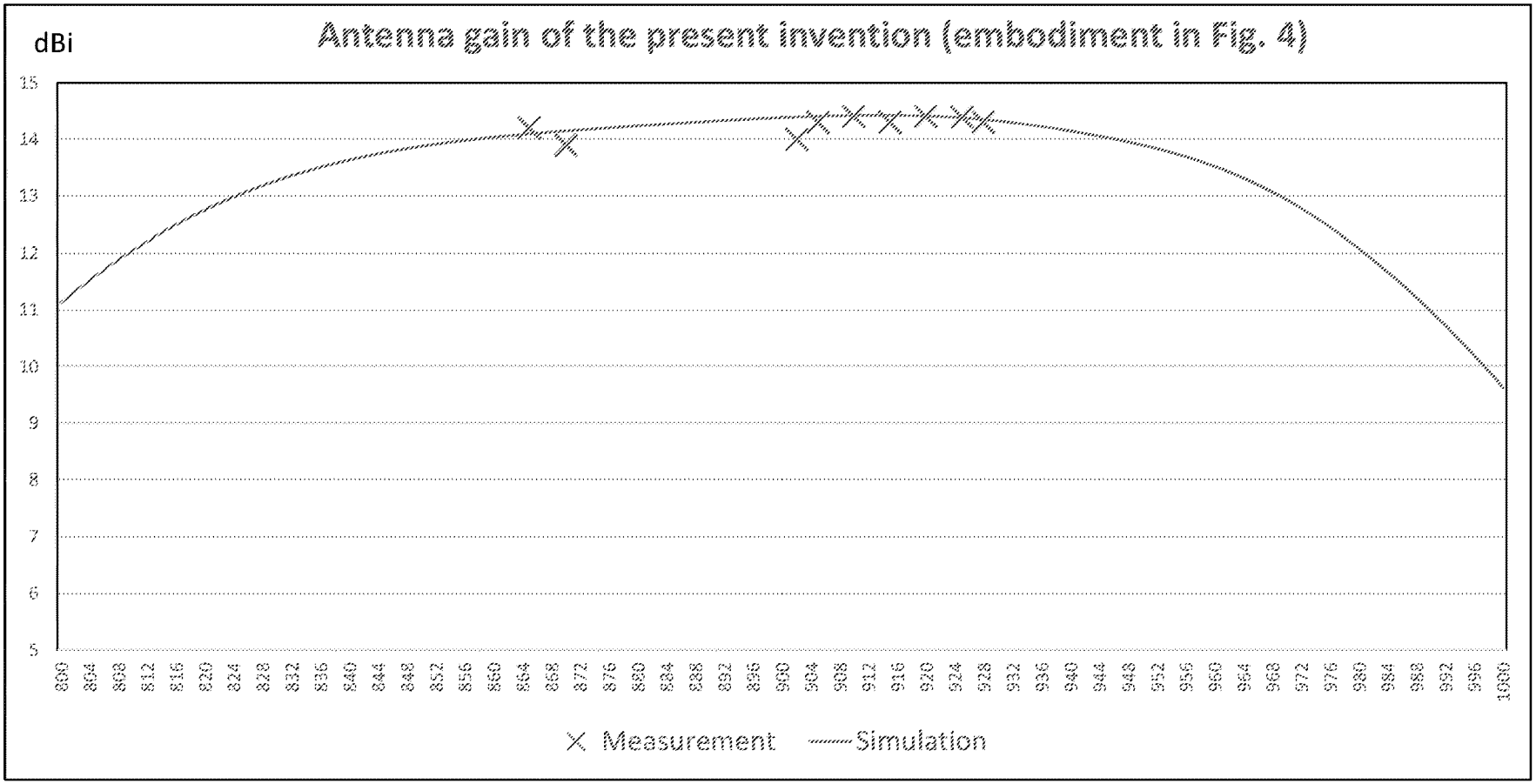
FIG. 16 is a plot showing the measured and simulated results of antenna gain of the antenna of FIG. 4.
Figure 17:
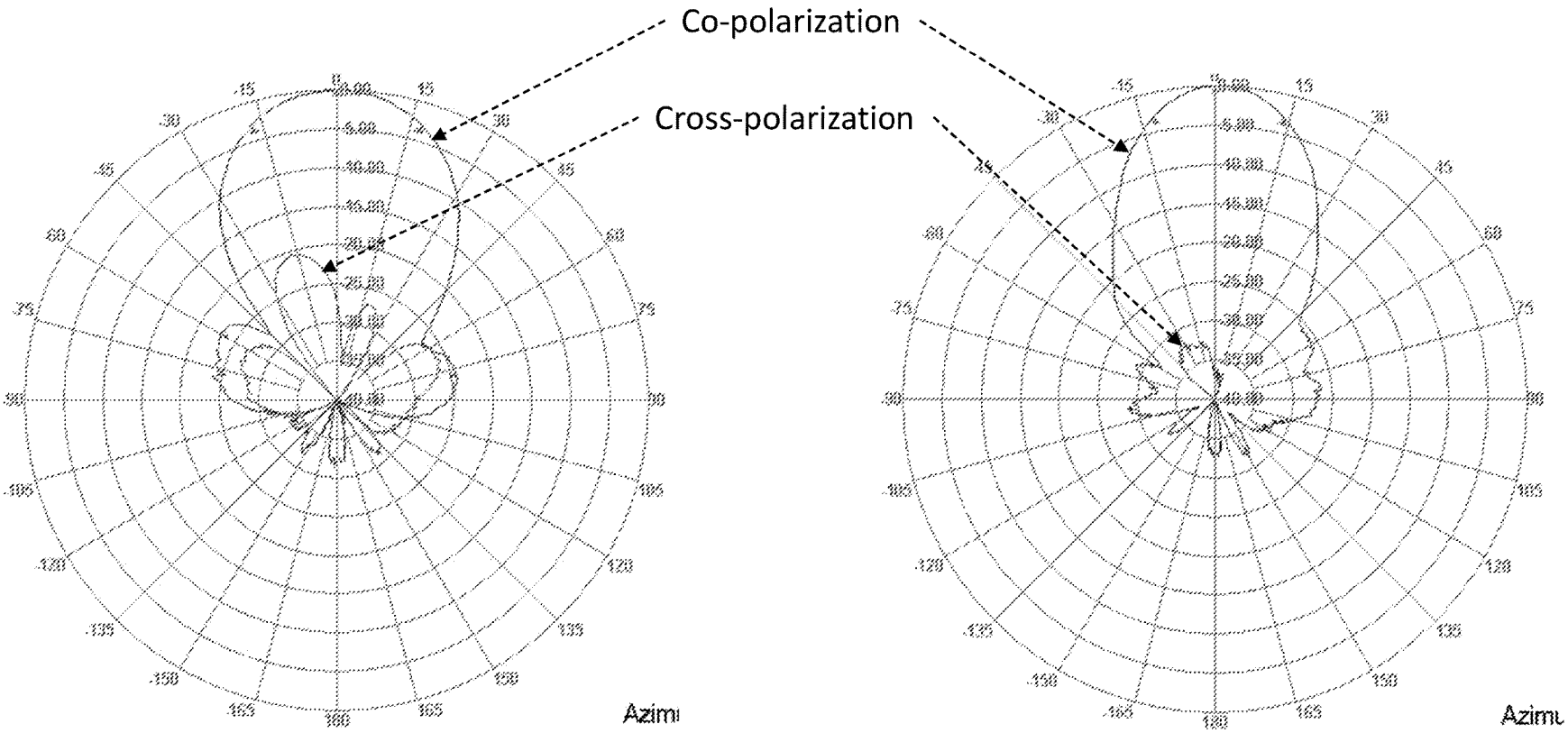
FIG. 17 is a plot showing the measured results of radiation pattern at 902 MHz of the antenna of FIG. 2.
Figure 18:
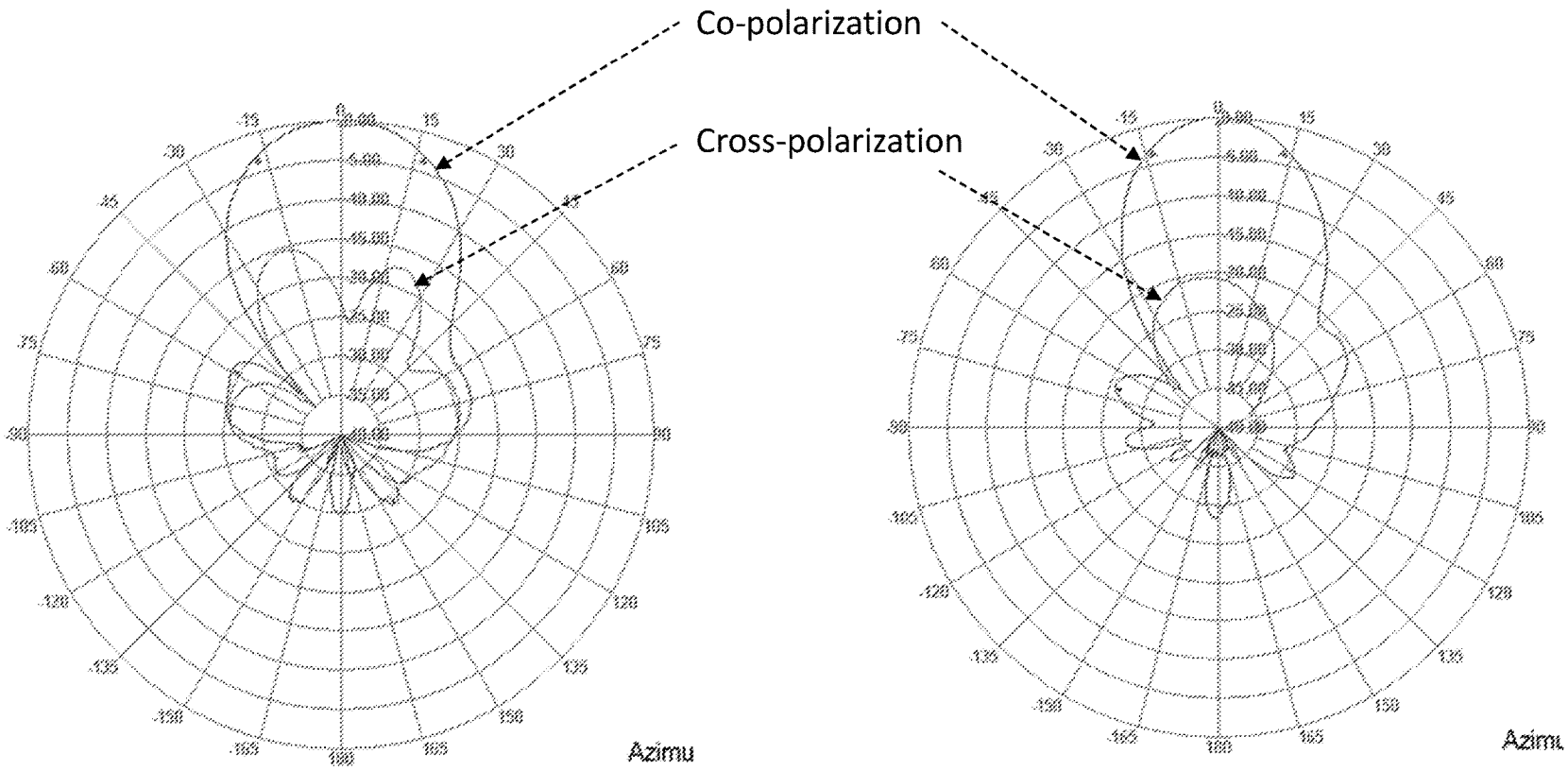
FIG. 18 is a plot showing the measured results of radiation pattern at 902 MHz of the antenna of FIG. 4.
Figure 19:
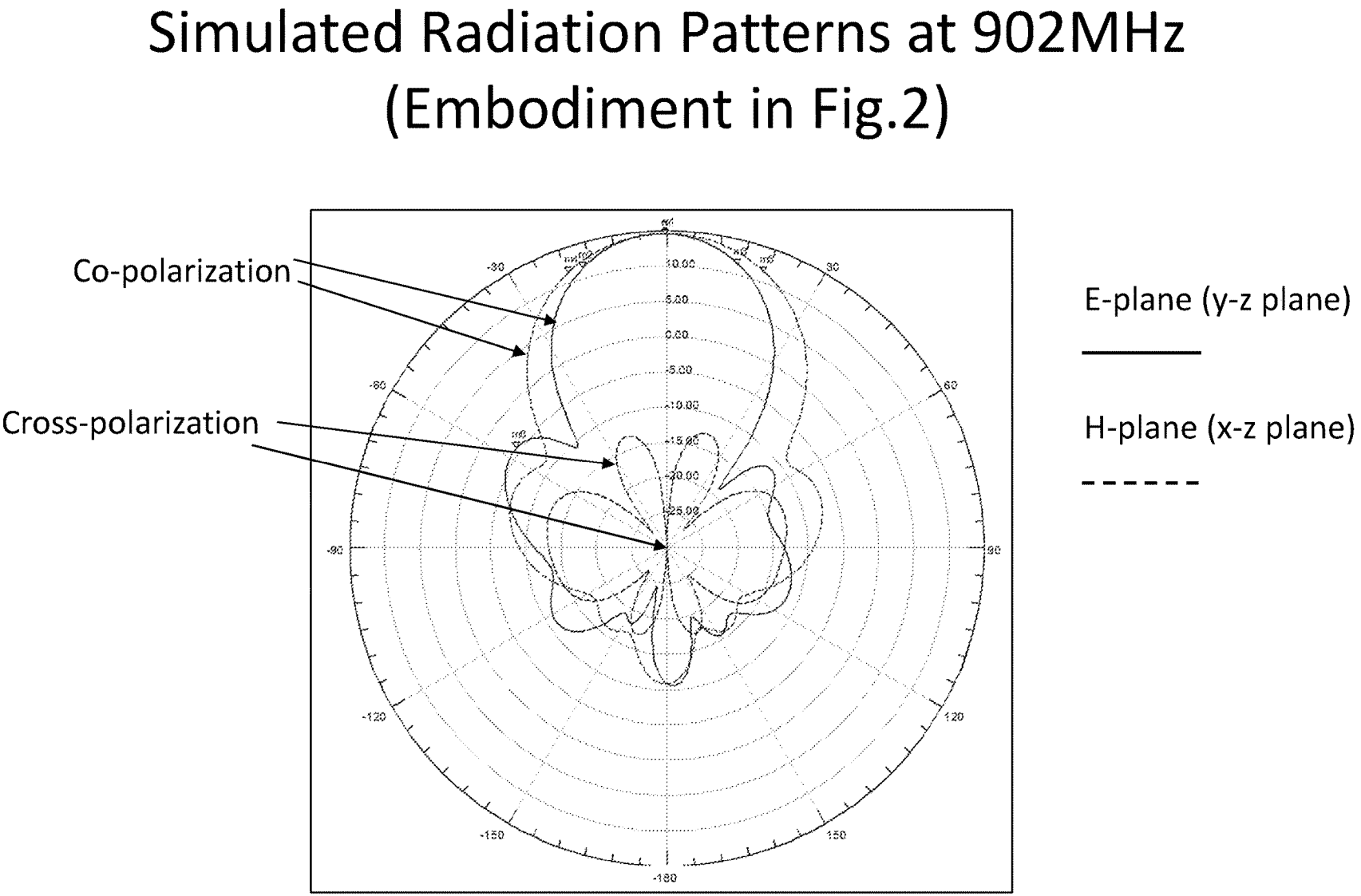
FIG. 19 is a plot showing the simulated results of radiation pattern at 902 MHz of the antenna of FIG. 2.
Figure 20:
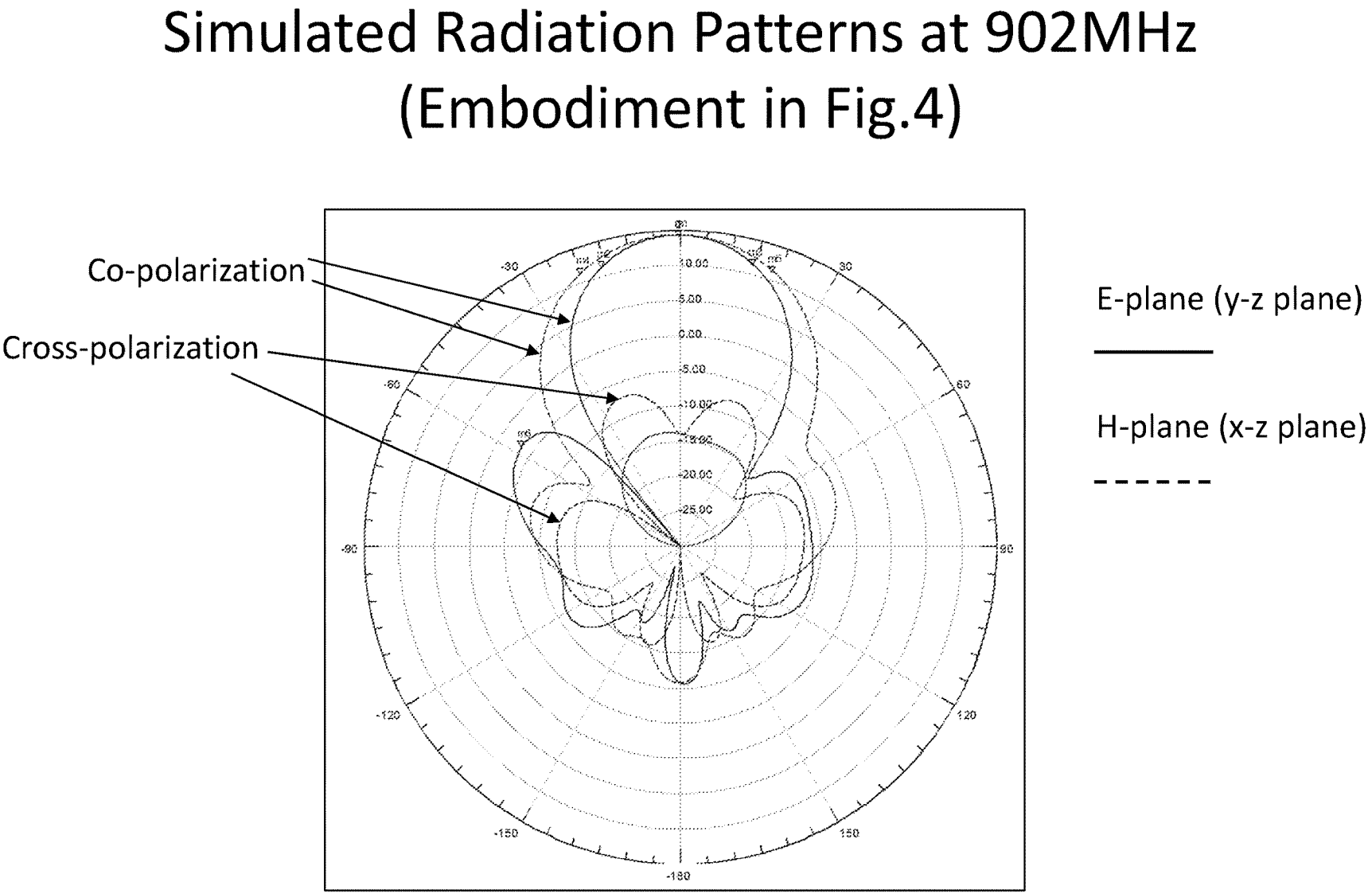
FIG. 20 is a plot showing the simulated results of radiation pattern at 902 MHz of the antenna of FIG. 4.

Preferably, it is worth choosing path k in FIG. 12 providing the achieved gain is high enough for some target applications.

By designing 1-to-2N port corporate feed network to feed N+k (K<N) elements not only can maintain the ease of designing the feed network, but also can help to minimize the overall antenna size.

Reference now is made to FIG. 12, where a preferable approach in designing an antenna of the present invention is disclosed.

Step 1: Using 1-to-N/2 port corporate feed network. Gain increased by 3 dB (compared to last step). Antenna volume increased by 100% (compared to last step).

Step 2: Using 1-to-N port corporate feed network. Gain increased by 3 dB (compared to last step). Antenna volume increased by 100% (compared to last step)

Step 3 is taken where in Step 3: Using 1-to-2N port corporate feed network. Gain increased by 3 dB (compared to last step). Antenna volume increased by 100% (compared to last step).

In addition, a person skilled in the art may customise the gain and volume by taking Step 4, wherein Step 4: Using 1-to-2N port corporate feed network. Gain increased by g dB (compared to last step). Antenna volume increased by $\{[(N+k)/N]-1\}\times 100\%$ (compared to last step). Theoretically, g (dB)=10 log 10 ((N+k)/N).

With reference to FIGS. 13 to 20, both simulated and measured radiation performance including antenna gain, return loss, radiation patterns of the embodiments of the present invention showed a wide bandwidth covering the band 865-928 MHz, high gain of 14.5 dBi (typical), low sidelobes level (below −15 dB), low cross-polarization level (below −15 dB), low back-lobe level (below −25 dB), etc.

The array antenna may comprises 6 radiating elements (patches), but using 1-to-8 port corporate feed network. The 2 center radiating elements are both differentially-fed by 2 input ports.

These embodiments may be advantageous in that the antenna the present invention may be designed with an overall array antenna size and weight being minimized, but maintaining the ease of corporate feed network design (1 to power-of-2 port), and the achievable radiating performance including directivity and antenna gain.

Advantageously, the present invention allows a larger freedom in terms of choosing the optimal number of radiating elements for their specific use while maintaining the ease in manufacturing as well as minimising the space used and weight of the antenna.

The antenna may be useful in applications where antennas are used, especially those of larger scale such as for RFID for electronic toll collection system, vehicle tracking and inventory management, in which the antenna needs to be fixed on a gantry or other locations where space and weight are limiting factors.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

Any reference to prior art contained herein is not to be taken as an admission that the information is common general knowledge, unless otherwise indicated.

What is claimed is:

1. An antenna comprising:

two or more radiation elements on a side of a substrate;

a ground plane on an opposite side of the substrate; and a 1-port to m-port feeding network including a plurality of branch feeding elements;

wherein each of the radiation elements has one or more feeding ports such that each of the plurality of branch feeding element is connected to a feeding port of a respective one of the radiation elements;

wherein the antenna further comprises n number of the radiation elements, and m number of the branch feeding elements such that m>n>1; m and n are positive integers;

where n is defined as the number of the radiation elements in an antenna array structure, and m is defined as the number of the branch feeding elements of the 1-port to m-port feeding network.

2. The antenna according to claim 1, wherein a number of the radiation elements is different from a number of the branch feeding elements.

3. The antenna according to claim 1, wherein the substrate is a dielectric substrate.

4. The antenna according to claim 3, wherein the substrate includes an air-substrate.

5. The antenna according to claim 1, wherein each of the radiation elements is coated with a superstrate layer.

6. The antenna according to claim 1, wherein the branch feeding element comprises a microstrip line.

7. The antenna according to claim 1, wherein the branch feeding elements are connected to a feeding point of the feeding network.

8. The antenna according to claim 1, wherein the radiation elements are arranged into three columns and two rows.

9. The antenna according to claim 8, wherein each radiation element of the first column has only one port connected to a branch feeding element.

10. The antenna according to claim 9, wherein each radiation element of the second column has two ports at opposite ends of the radiation element, and each port is connected to a branch feeding element.

11. The antenna according to claim 10, wherein each radiation element of the third column has only one port connecting to a branch feeding element.

12. The antenna according to claim 11, wherein the feeding ports of the radiation element of the first column are adapted to operate at 0 degree phase difference.

13. The antenna according to claim 12, wherein the feeding ports of radiation elements in the second column adjacent to the first column are adapted to operate at 180 degree phase difference.

14. The antenna according to claim 13, wherein the feeding ports of radiations elements in the second column adjacent to the third column are adapted to operate at 0 degree phase difference.

15. The antenna according to claim 14, wherein the feeding ports of the radiation elements in the third column are adapted to operate at 180 degree phase difference.

16. The antenna according to claim 1, wherein the branch feeding elements connected to the feeding ports operating in 0 degree phase difference has a $d_1$ length, and the branch feeding elements connected to the feeding ports operating in 180 degree phase difference has a $d_2$ length, such that $d_1-d_2=(2k+1)(\lambda_g/2)$, wherein k is any integer, and $\lambda_g$ is the guided wavelength.

17. The antenna according to claim 16, wherein two radiation elements in a same row have a space of around 190 mm between the centres of the radiation elements.

18. The antenna according to claim 17, wherein two radiation elements in a same column have a space of around 220 mm between the centres of the radiation elements.

19. The antenna according to claim 1, wherein n is an integer number greater than or equals to 2.

* * * * *